US006419449B2

(12) United States Patent
Ferber

(10) Patent No.: US 6,419,449 B2
(45) Date of Patent: Jul. 16, 2002

(54) COOLED FLOW DEFLECTION APPARATUS FOR A FLUID-FLOW MACHINE WHICH OPERATES AT HIGH TEMPERATURES

(75) Inventor: Jörgen Ferber, Küssaberg (DE)

(73) Assignee: ALSTOM (Switzerland) Ltd, Baden (CH)

( * ) Notice: Subject to any disclaimer, the term of this patent is extended or adjusted under 35 U.S.C. 154(b) by 0 days.

(21) Appl. No.: 09/750,003

(22) Filed: Dec. 29, 2000

(30) Foreign Application Priority Data

Dec. 29, 1999 (DE) ..... 199 63 716

(51) Int. Cl.[7] ..... F01D 5/18
(52) U.S. Cl. ..... 416/96 A; 416/97 R; 416/96 R
(58) Field of Search ..... 415/115, 116; 416/97 A, 96 A, 97 R, 96 R, 95, 92

(56) References Cited

U.S. PATENT DOCUMENTS 3,369,792 A 2/1968 Kraimer et al. ..... 415/115
3,628,885 A * 12/1971 Sidenstick et al. ..... 416/193 A
4,257,734 A * 3/1981 Guy et al. ..... 415/115
5,193,980 A 3/1993 Kainez et al. ..... 416/97 R
5,203,873 A * 4/1993 Corsmeier et al. ..... 416/96 A
6,238,182 B1 * 5/2001 Mayer ..... 415/115

FOREIGN PATENT DOCUMENTS

| | | |
|---|---|---|
| DE | 29 09 315 | 4/1979 |
| DE | 691 00 957 | 2/1994 |
| GB | 1078116 | 6/1964 |

* cited by examiner

*Primary Examiner*—F. Daniel Lopez
*Assistant Examiner*—Richard Woo
(74) *Attorney, Agent, or Firm*—Burns, Doane, Swecker & Mathis, L.L.P.

(57) ABSTRACT

Apparatus is disclosed for providing cooling channels in the interior of a gas turbine rotor blade. The cooling channels are formed by metallic inserts which extend from adjacent the root of the blade toward the tip. The inserts are substantially flat and are secured in the interior of the airfoil section by means of rails which engage the longitudinal edges of the inserts and serve as a guide during insertion. The rails are preferable formed integrally with the blade casting.

14 Claims, 2 Drawing Sheets

COOLED FLOW DEFLECTION APPARATUS FOR A FLUID-FLOW MACHINE WHICH OPERATES AT HIGH TEMPERATURES

This application claims priority under 35 U.S.C. §§ 119 and/or 365 to Appln. No 199 63 716.4 filed in Germany on Dec. 29, 1999; the entire content of which is hereby incorporated by reference.

FIELD OF THE INVENTION

The present invention relates to cooled stator blades or rotor blades for a gas turbine.

Such a flow deflection apparatus is generally known from the prior art, for example in the form of a cooled stator blade or rotor blade for a gas turbine.

BACKGROUND OF THE INVENTION

Present-day flow deflection apparatus, especially stator blades or rotor blades in a gas turbine, are subjected to ambient temperatures which are above the maximum permissible material temperature. The use of special internal cooling channels reduces the metal temperature to a level which allows operation of such apparatus at high temperatures.

FIGS. 1 and 2 respectively show a cross section and longitudinal section of an example of a rotor blade of a gas turbine, as is currently used. The blade 10 essentially comprises a blade airfoil section 11 and a blade root 12, by means of which it is attached to the rotor of the gas turbine. A number of cooling channels 17 run in the longitudinal direction of the blade 10 in the interior of the (hollow) blade airfoil section 11, through which cooling channels 17 a cooling fluid, generally cooling air which enters through the blade root 12, flows. The cooling fluid runs, with a cooling effect, in the cooling channels 17 along the insides of the hot-gas walls 14 and then (for film cooling) emerges to the outside through appropriate film-cooling openings which are arranged on the leading edge 18, on the trailing edge 19 and at the blade tip (the emerging cooling fluid is indicated by the arrows in FIG. 2). The individual cooling channels 17 are separated from one another by separating walls 13 which at the same time have deflection devices 16 to ensure that the cooling fluid flows successively through adjacent cooling channels in alternately opposite directions.

Until now, and in this case specifically in the case of rotating guide apparatuses such as rotor blades, the cooling channels 17 and their separating walls 13 have been cast.

The known, cast separating walls 13 and deflection devices 16, which are also referred to as ribs, have a number of disadvantages, however:

The transitional region (15 in FIG. 1) from the hot-gas wall 14 to the separating wall (rib) 13 is an area which is difficult to cool owing to the large amount of material in that area. Increased heat transfer together with increased cooling-air consumption is required in order to ensure adequate strength there. The cold separating walls (ribs) 13, around which the cooling air flows, lead to thermal stresses with the hot-gas wall 14.

Casting of the internal channels leads to a high blade weight, which can lead to high centrifugal-force stresses both for the blade root 12 and for the blade airfoil section 11.

The complex casting lengthens casting development and increases the amount of scrap.

SUMMARY OF THE INVENTION

The object of the invention is thus to provide a cooled flow deflection apparatus which avoids the described disadvantages of the known apparatus and in particular is simple to produce, can be flexibly matched to the respective application, and is efficiently cooled.

The object is achieved by constructing the separating walls as separate inserts which are subsequently inserted into the apparatus, and are secured there. The invention is thus considerably different from solutions such as those described in U.S. Pat. No. 5,145,315 or U.S. Pat. No. 5,516,260, in which specific inserts in cast cooling channels are used for specific guidance of the cooling fluid.

The use of inserts (for example, in the case of blades, inserted through the blade root or through the blade tip) composed of metal or non-metal materials as a substitute for cast separating walls and, possibly, deflection devices, has a number of advantages:

- There is no large amount of material in the transitional region from the hot-gas wall to the insert (to the separating wall).
- There are no thermal stresses between the insert (separating wall) and the hot-gas wall.
- In the case of rotating blades, the blade weight and thus the centrifugal-force stresses are reduced both in the blade root and in the blade airfoil section.
- In the case of cast blades, the cast core is simpler, as a result of which both its capability to be produced and that of the blade are simpler.
- The cooling system can easily be adjusted by replacing the inserts, for example by varying the deflection radius of deflection devices or by introducing connecting cross sections between two cooling channels.

A first preferred embodiment of the flow deflection apparatus according to the invention is characterized in that the flow deflection apparatus is in the form of a hollow casting, and in that holders, which are in the form of rails and into which the separating walls are inserted, are integrally formed in the interior of the flow deflection apparatus. This considerably simplifies assembly and attachment of the inserts, and ensures that the separating walls or inserts are sealed well at the edges. The separating walls are in this case preferably flat strips composed of a metallic or heat-resistant non-metallic (ceramic or composite) material.

A secure seating for the inserts is achieved if, according to a second preferred embodiment of the invention, the inserted separating walls are, for security, connected by an integral material joint, preferably by soldering or welding, to the flow deflection apparatus.

In the simplest form, the separating walls may be straight.

It is particularly simple and advantageous if, according to another embodiment, the cooling fluid flows in mutually opposite directions in two adjacent cooling channels, if the cooling fluid is deflected from the outlet of the one cooling channel into the inlet of the other cooling channel by means of a deflection device, and if the deflection is produced by a separating wall which is bent into a U-shape.

One particularly preferred embodiment of the flow deflection apparatus according to the invention is characterized in that the flow deflection apparatus is a blade in a gas turbine. Owing to the comparatively complex geometry of the blade, the invention in this case results in considerable simplifications.

Another embodiment, which is particularly advantageous for rotor blades which rotate at high speed, is characterized in that the cooling channels and separating walls extend essentially in the radial direction with respect to the rotation axis of the gas turbine, in that the inserted separating walls are, for security, connected by an integral material joint, preferably by soldering or welding, to the blade, and in that the integral material joint is arranged at the end of the separating walls close to the axis.

BRIEF DESCRIPTION OF THE DRAWINGS

The invention will be explained in more detail in the following text with reference to preferred embodiments and in conjunction with the drawings, in which.

DETAILED DESCRIPTION OF THE INVENTION

Figure 2:
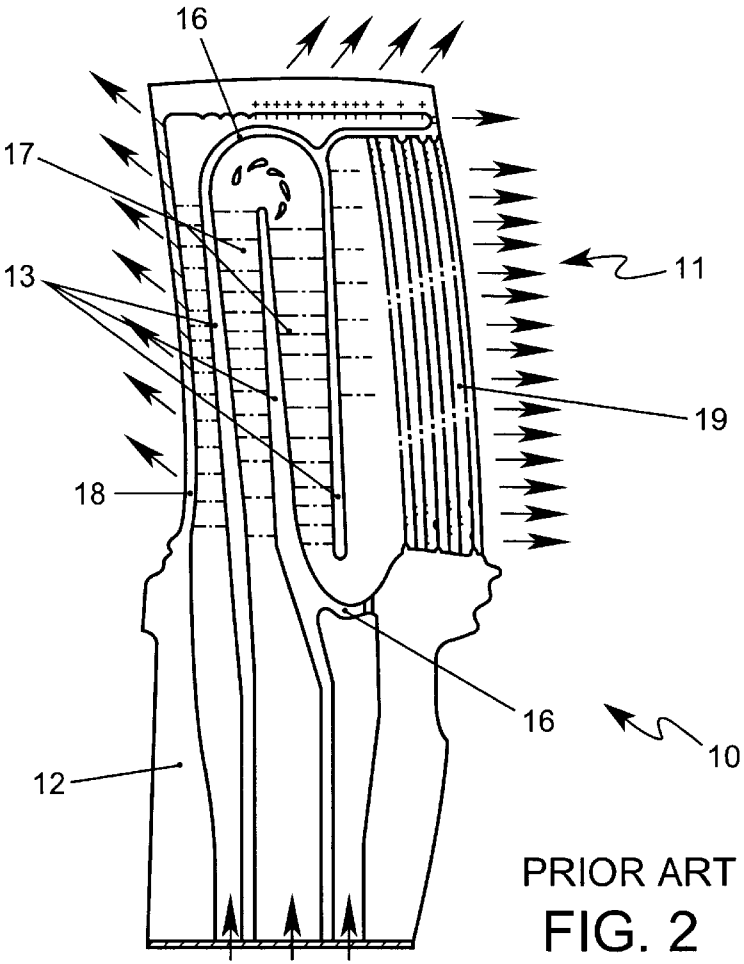
PRIOR ART FIG. 2
FIG. 2 shows a longitudinal section through the blade shown in FIG. 1.
Figure 4:
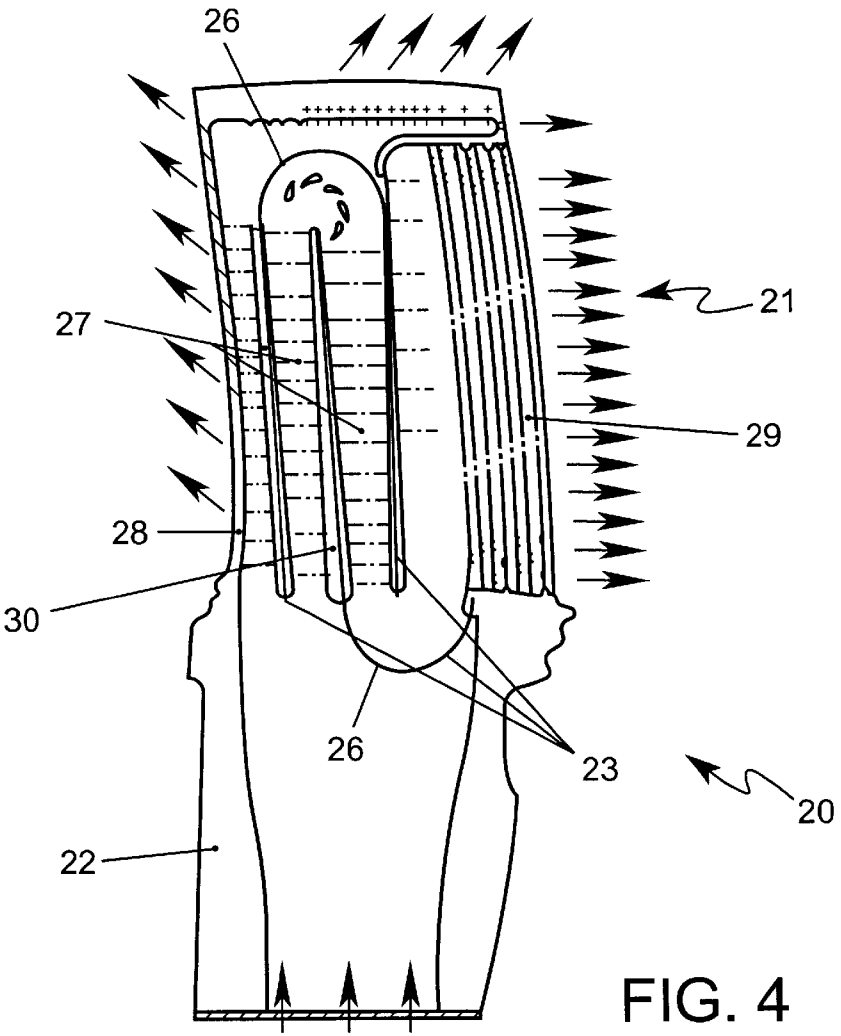
FIG. 4 shows a longitudinal section, comparable to that in FIG. 2, through the blade shown in FIG. 3.
Figure 3:
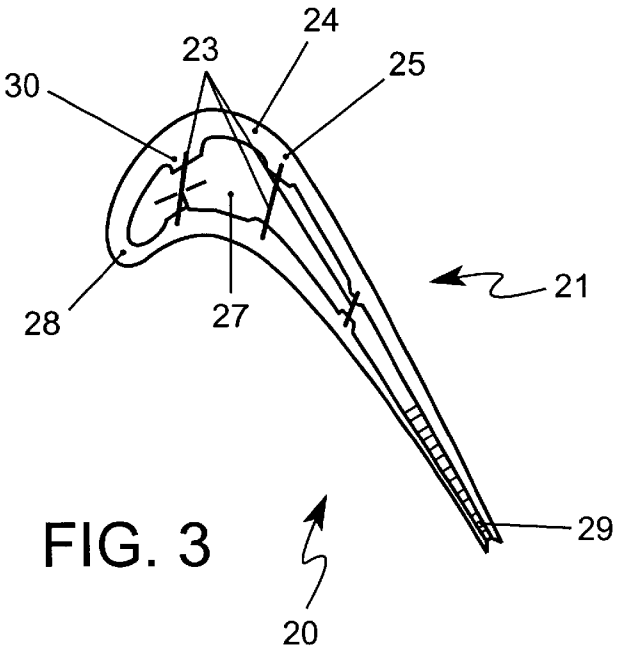
FIG. 3 shows a cross section, comparable to that in FIG. 1, through a blade according to a preferred embodiment of the invention.

FIG. 3 and 4 respectively show a cross section and longitudinal section of an exemplary embodiment of a cooled flow deflection apparatus according to the invention in the form of a rotor blade for a gas turbine. The geometry of the blade 20 is similar to that of the known blade 10 shown in FIGS. 1 and 2.

Once again, the blade 20 essentially comprises a blade airfoil section 21 and a blade root 22, by means of which it is attached to the rotor of the gas turbine. A number of cooling channels 27, through which a cooling fluid which enters through the blade root 22 flows, run in the longitudinal direction of the blade 20, in the interior of the (hollow) blade airfoil section 21. The cooling fluid runs in cooling channels 27 along the insides of the hot-gas walls 24, with a cooling effect, and in this case as well emerges to the outside through appropriate film cooling openings which are arranged on the leading edge 28, on the trailing edge 29, and at the blade tip. The individual cooling channels 27 are separated from one another by separating walls 23 which at the same time have deflection devices 26 to ensure that the cooling fluid flows successively through adjacent cooling channels in alternately opposite directions.

Figure 1:
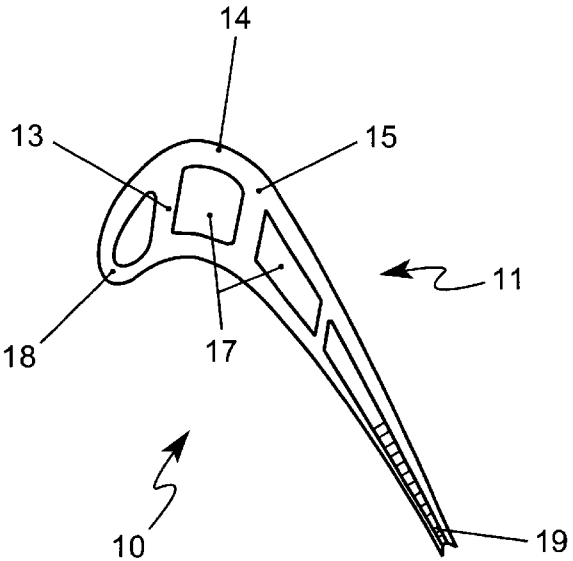
PRIOR ART FIG. 1
FIG. 1 shows the cross section through a turbine blade having cast cooling channels according to the prior art.

In contrast to the blade shown in FIGS. 1 and 2, the separating walls 23 are in this case not cast, however, that is to say produced together with the blade 20 in one casting process, but are separate inserts, in the form of strips, which, once the blade 20 has been cast, are introduced through the blade root 22 or through the opposite blade tip. In order to allow the separating walls 23 to be inserted as required and to be secured after insertion, holders 30 which are in the form of rails and in which the longitudinal edges of the separating walls 23 are guided during insertion are integrally formed on the insides of the hot-gas walls.

The separating walls (inserts) 23 may have any desired shape. For example, they may be straight. If a number of cooling channels are intended to be connected to one another by means of deflection devices 26, it is advantageous for the separating walls 23 to be bent into a U-shape. The separating walls 23 can be secured on one or more sides, for example by soldering or welding. They may be fixed in the blade tip region or in the blade root region. The latter has the advantage that the centrifugal forces which occur load the insert or the separating wall in tension, thus preventing them from bulging out.

In principle, the separating walls which can be inserted are provided at the same time that the blades are produced. However, it is also feasible within the scope of the invention for the cast separating walls subsequently to be removed from completely cast blades as shown in FIGS. 1 and 2 and for separate separating walls to be inserted and to be secured as a substitute for them.

What is claimed is:

1. A cooled flow deflection apparatus for a fluid-flow machine which operates at high temperatures, which flow deflection apparatus has a leading edge and a trailing edge and an interior defined between the leading edge and the trailing edge, a number of parallel-running cooling channels formed in the interior, which are separated from one another by separating walls for a cooling fluid to pass through, wherein the separating walls are in the form of separate inserts which can be pushed into the flow deflection apparatus subsequently;

the cooling fluid flows in mutually opposite directions in two adjacent cooling channels, the cooling fluid being deflected from the outlet of the one cooling channel into the inlet of the other cooling channel by means of a deflection device, and the deflection being produced by a separating wall which is bent into a U-shape; and the separate inserts being spaced apart from each other successively from the leading edge to the trailing edge and defining at least one path through the interior from the leading edge to the trailing edge.

2. The flow deflection apparatus as claimed in claim 1, wherein the flow deflection apparatus is in the form of a hollow casting, and in that holders, which are in the form of rails and into which the separating walls are inserted, are integrally formed in the interior of the flow deflection apparatus.

3. The flow deflection apparatus as claimed in claim 1, wherein the separating walls are in the form of flat strips composed of at least one of a metallic material and a heat-resistant non-metallic material.

4. The flow deflection apparatus as claimed in claim 1, wherein the inserted separating walls are connected by an integral material joint to the flow deflection apparatus, in order to secure them.

5. The flow deflection apparatus as claimed in claim 1, wherein the separating walls are straight.

6. The flow deflection apparatus as claimed in claim 1, wherein the flow deflection apparatus is a blade in a gas turbine.

7. The flow deflection apparatus as claimed in claim 6, wherein the blade is a rotor blade, in that the cooling channels and separating walls extend essentially in the radial direction with respect to the rotation axis of the gas turbine, in that the inserted separating walls are, for security, connected by an integral material joint to the blade, and the integral material joint is arranged at the end of the separating walls close to the axis.

8. A gas turbine blade comprising an airfoil section and a blade root, the interior of the blade having a plurality of cooling channels separated from each other by separating walls, the blade having a leading edge and a trailing edge and the interior of the blade having rails, the separating walls being in the form of separate inserts engaging the rails and being supported thereby;

cooling fluid flows in mutually opposite directions in two adjacent cooling channels, the cooling fluid being deflected from the outlet of the one cooling channel into the inlet of the other cooling channel by means of a deflection device, and the deflection being produced by a separating wall which is bent into a U-shape; and the separate inserts being spaced apart from each other successively from the leading edge to the trailing edge and defining at least one path through the interior from the leading edge to the trailing edge.

9. The gas turbine blade as claimed in claim 8, wherein the inserts are curved to deflect cooling air from one of the cooling channels to another cooling channel.

10. The gas turbine blade as claimed in claim 8, wherein the inserts are formed of flat metallic strips.

11. A gas turbine blade comprising a metallic casting in the shape of a blade having a blade airfoil section and a blade root, the casting having a hollow space in the interior of the airfoil section, and the airfoil section having a leading edge and a trailing edge, cooling channels in the hollow space arranged for receiving a cooling fluid from the blade root and directing the cooling fluid toward the tip of the airfoil section, the cooling channels including a plurality of inserts in the interior of the airfoil section, the inserts being secured by holders in the hollow interior of the airfoil section;

the cooling fluid flows in mutually opposite directions in two adjacent cooling channels, the cooling fluid being deflected from the outlet of the one cooling channel into the inlet of the other cooling channel by means of a deflection device, and the deflection being produced by an insert which is bent into a U-shape; and the separate inserts being spaced apart from each other successively from the leading edge to the trailing edge and defining at least one path through the interior from the leading edge to the trailing edge.

12. The gas turbine blade as claimed in claim 11, wherein the blade is a rotor blade.

13. The gas turbine blade as claimed in claim 11, wherein the holders are in the from of rails for guiding the insertion of the inserts in the interior of the airfoil section.

14. The gas turbine blade as claimed in claim 11, wherein the inserts are secured in the holders by at least one of soldering and welding.

* * * * *